United States Patent [19]

Carroll et al.

[11] Patent Number: 4,465,132

[45] Date of Patent: Aug. 14, 1984

[54] RELEASABLE WELL TOOL STOPPING DEVICES AND SYSTEMS

[75] Inventors: Albert W. Carroll; Joseph L. Pearce, both of Dallas, Tex.

[73] Assignee: Otis Engineering Corporation, Dallas, Tex.

[21] Appl. No.: 444,188

[22] Filed: Nov. 24, 1982

[51] Int. Cl.[3] ..... E21B 23/08

[52] U.S. Cl. ..... 166/156; 166/212; 285/306

[58] Field of Search ..... 166/156, 212, 214, 113, 166/237, 382, 383, 125, 153, 154, 155; 285/304, 306, 315, 317, 39, DIG. 21; 294/86.15, 86.33

[56] References Cited

U.S. PATENT DOCUMENTS

| | | | |
|---|---|---|---|
| 2,673,614 | 3/1954 | Miller | 166/214 |
| 3,510,153 | 5/1970 | Newton | 285/315 X |
| 3,696,868 | 10/1972 | Taylor | 166/322 X |
| 3,937,279 | 2/1976 | Raulins | 166/214 |
| 4,043,392 | 8/1977 | Gazda | 166/154 X |
| 4,114,694 | 9/1978 | Dinning | 166/318 |
| 4,126,179 | 11/1978 | Long | 166/156 X |
| 4,190,107 | 2/1980 | Oden et al. | 285/306 X |
| 4,406,325 | 9/1983 | Bowyer | 166/214 |

*Primary Examiner*—Ernest R. Purser
*Assistant Examiner*—Michael Starinsky
*Attorney, Agent, or Firm*—Albert W. Carroll

[57] ABSTRACT

A tool stopping device for use in a well flow conductor having a preferably full open bore and an abrupt stop shoulder surrounding the bore and engageable by corresponding stop shoulders of spring biased keys carried on a well tool for stopping the well tool as it moves through the flow conductor to indicate the tool's arrival at the device, the device having lugs remotely actuable from the surface for releasing the keys from engagement with the stop shoulder in the device for movement of the well tool therebeyond. One form of the device is suitable for stopping tools entering from one direction only. Another form of the device is suitable for stopping tools both moving into and out of a well. Either or both types of devices may be used in any quantity to provide known checkpoints in a well system for monitoring the progress of well tools moving therethrough.

17 Claims, 7 Drawing Figures

RELEASABLE WELL TOOL STOPPING DEVICES AND SYSTEMS

This application is related to co-pending application entitled "WELL TOOL STOPPING DEVICES, SYSTEMS AND METHODS" filed 11/24/82 and given Ser. No. 444,496.

BACKGROUND OF THE INVENTION

1. Field of the Invention

This invention relates to well tools and more particularly to devices for temporarily stopping well tools at known checkpoints in their movement through well flow conductors.

2. Description of the Prior Art

In performing operations in wells through use of pumpdown tools and techniques wherein well tools are moved into and out of wells by circulating fluids such as water or oil through the well, it is often desirable to know the location of the tools in the system. In the past, the circulating medium has been measured, and this volume together with the unit volume of the well flow conductor has been used to roughly compute the location of the tools in the well during such operations. Such indications are highly inaccurate because, as is well known, the pumpdown tools have of necessity a built-in bypass which allows fluids to pass through or around them. Such bypass is necessary in case the tool train becomes fouled in the well and another tool train must be sent down to free and retrieve the fouled tool train. This second train can be pumped into the well only if fluids will pass through or around the first tool train. Thus, and especially in wells where the tool trains must be pumped as much as 5 or 10 miles to the lower portions of the wells, the location of such tool trains may not be determinable within several thousand feet.

Related co-pending application for WELL TOOL STOPPING DEVICES, SYSTEMS AND METHODS mentioned above discloses devices which are made up in the flow conductors of wells at known locations therein and which have remotely actuable lug means which are controlled from the surface. These lug means when in normally retracted position do not protrude into the bore of the flow conductor and, so, will allow well tools to move therepast unhindered. When actuated to tool-engaging position, these lugs project into the bore of the flow conductor and will cause well tools to lodge thereagainst. Since the tools are moved through the flow conductor by force of pumped fluids, the stoppage of the tools restricts flow appreciably and, thus, causes an increase in pump pressure. This increase in pressure is observed at the surface, and it is thereby known that the tools have reached such checkpoint. The lugs are then retracted and the tools allowed to pass through and beyond that checkpoint. The next such tool stopping device is then actuated so that the tools will be stopped, thereby causing another increase in pump pressure, indicating arrival of the tools thereat.

Such devices are intended for stopping of ordinary tools. However, if the tool train to be stopped includes, for instance, a safety valve, or the like, which is being run into the well on a running tool having a shear pin which releases the safety valve responsive to one or more jarring impacts, the shear pin may become sheared and the safety valve lost in the well as a result of the tool train being stopped at one or more such tool stopping devices.

The present invention is embodied in a well tool stopping device specifically designed to stop tool trains which include a running tool or similar tool having a shear pin. This tool train is equipped with key means having an abrupt stop shoulder thereon and located in the train at a locaton above the running tool. These keys may be like those disclosed in U.S. Pat. No. 2,673,614. The tool stopping device preferably has a full-opening bore and a surrounding abrupt stop shoulder like that also disclosed in U.S. Pat. No. 2,673,614. Thus, when the keys on the tool train enter the device, their stop shoulders will engage to arrest movement of the train.

To release the tool train for movement beyond the device at which it stopped, the device is provided with lugs which are actuated remotely to contracted position to depress the keys and disengage their abrupt shoulders from those of the device and permit the tool train to move therebeyond. This tool stopping device does not restrict the bore of the flow conductor even when the lugs are in their innermost position.

Related prior art includes the following patents.

U.S. Pat. No. 2,673,614
U.S. Pat. No. 3,696,868
U.S. Pat. No. 3,937,279
U.S. Pat. No. 4,114,694

U.S. Pat. No. 2,673,614 issued to Ira A. Miller on Mar. 30, 1954 discloses a full opening receptacle having an abrupt stop shoulder surrounding its bore, which shoulder is engageable by a corresponding abrupt stop shoulder on keys carried on a lock device installable in the receptacle. The lock device is lowered in the well and will stop when it encounters the receptacle for which it is fitted. This receptacle has no means for then releasing the keys to permit the lock device to move therepast.

U.S. Pat. No. 3,696,868 issued to Donald F. Taylor, Jr. on Oct. 10, 1972 discloses a downhole safety device having a piston actuable remotely from the earth's surface for holding the safety device open to permit production therethrough. A control mechanism at the surface maintains control pressure on a fluid line communicating with the piston and will respond to an emergency condition by bleeding the pressure from the control line and allowing the safety device to shut off well flow at its subsurface level.

U.S. Pat. No. 3,937,279 issued to George M. Raulins on Feb. 10, 1976 discloses a downhole well device which has a retractable stop shoulder. An internal sleeve has collet fingers on one end thereof, and each of these fingers has an internal boss thereon. In one position of the sleeve, the fingers inherently assume a position in which their bosses do not project into the bore of the well flow conductor. The sleeve is shiftable to its other position in which its fingers are cammed inwardly to a position in which their bosses project into and restrict the bore of the flow conductor and are able to stop well tools which might engage them. This sleeve is not remotely shiftable.

U.S. Pat. No. 4,114,694 issued to Robert W. Dinning on Sept. 19, 1979. This patent discloses a downhole device having a body with a lateral window, a lug carried in the window and a hoop surrounding the lugs (FIG. 11) so that it projects through the window and is engaged in a recess in a plug in the bore of the body to hold the plug in place. A piston is movable by a spring, after the pressure in the flow conduit has been built up and then decreased, to move the hoop to a neutral poisiton and allow the lugs to move outwards and release the plug (FIG. 12).

None of the known prior art patents disclose a device having an open bore therethrough and an abrupt stop shoulder surrounding the bore for engaging and stopping a well tool having key means thereon with an abrupt stop shoulder, this tool stopping device having remotely operated means for disengaging the stop shoulder on the keys from the stop shoulder in the device to, thus, release the well tool for movement past and beyond the device.

SUMMARY OF THE INVENTION

The present invention is directed to well devices for use at known locations in well flow conductors for selectively stopping and subsequently releasing well tool trains moving through the conduit, the device having an open bore therethrough and an abrupt stop shoulder surrounding the bore, this stop shoulder being engageable by a corresponding abrupt stop shoulder on a tool train to stop the tool train so that its location in the conduit can be known, the device also having remotely operable means for disengaging the engaged stop shoulders of the device and tool train so that the tool train may be moved through and beyond the device.

It is therefore one object of this invention to provide a tool stopping device having a shoulder therein for engaging and stopping a tool train and means for then releasing the tool train for continued travel through a flow conductor.

Another object is to provide a device of the character just described wherein the bore of the device is full opening.

Another object is to provide such a device having means for releasing the tool train which is operated remotely.

A further object is to provide such a device in which the releasing means is operated by fluid pressure conducted thereto from the surface.

Another object is to provide a device of the character described wherein its full opening bore is unrestricted regardless of whether the releasing means is in releasing or non-releasing position.

Another object is to provide a device of the character described having lugs mounted in lateral windows near its abrupt stop shoulder and cam means operated remotely for moving the lugs inwardly to depress spring biased keys on the tool train to disengage them from the stop shoulder in the device to permit the tool train to be released for continued travel beyond the device.

Another object is to provide a device of the character described having lug operating cam means actuated by a piston powered by fluid pressure conducted thereto from a remote location such as the earth's surface.

Another object is to provide such a device wherein fluid pressure is conducted thereto from the surface through a control line disposed exterior of the tubing.

Other objects and advantages will become apparent from reading the description which follows and from studying the accompanying drawing, wherein:

DESCRIPTION OF THE DRAWING

Referring now to FIG. 1, it will be seen that a well 10 has its bore cased with casing 12 which penetrates producing formation 13. The casing is perforated as at 14 to provide entry for well fluids entering the casing from the formation. A string of tubing 16 is disposed in the well casing 12, and a packer 17 seals between the tubing and the casing just above the perforations 14 while a wellhead 18 seals about the tubing at the upper end of the casing as shown. The tubing is equipped with a master valve or Christmas tree 20 which communicates with a flow line which may be curved as shown at 22 to provide access for pumpdown tools, or, alternatively, could be of the conventional type as shown in dotted lines at 23. In either case, the flow line will transport well products from the well to a suitable handling or storage facility (not shown) for disposal.

Figure 1:
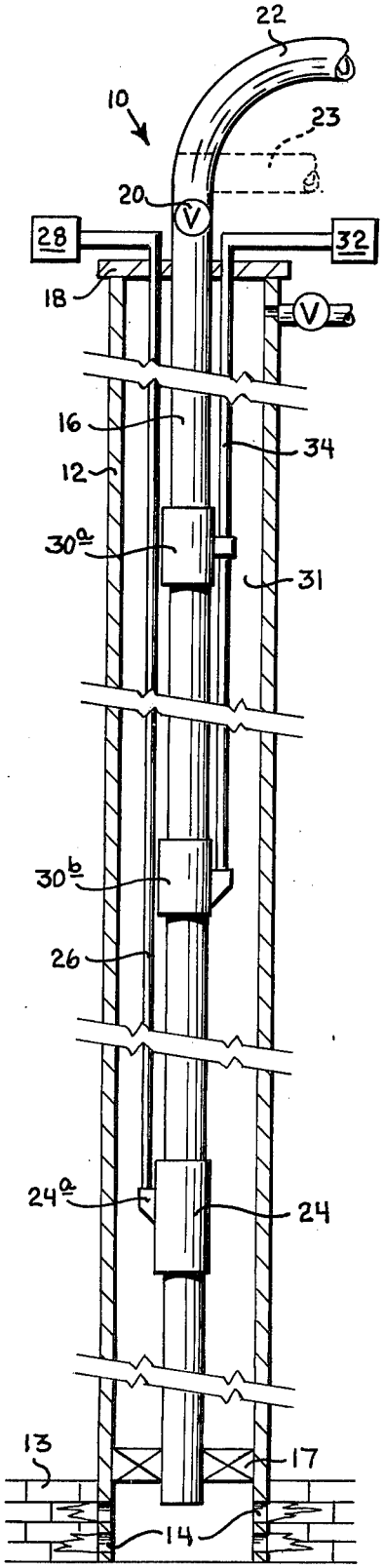
FIG. 1 is a diagrammatical view of a well installation showing a well tubing disposed in a well casing and being equipped with a plurality of tool stopping devices of this invention which are actuable from the surface, the tubing also including a landing nipple for a surface controlled subsurface safety valve.

The well tubing 16 includes a landing nipple 24 which will receive a suitable safety device which will be controlled from the surface by fluid pressure conducted to it through control line 26 extending to the landing nipple 24 from control unit 28 which is preferably on the earth's surface. Control pressure applied through control line 26 will hold open the safety device in the landing nipple 24 and allow the well to produce therethrough. Control unit 28 is equipped with apparatus which is responsive to undesirable conditions and will react in an emergency to bleed the pressure from control line 26 and cause or allow the safety device in nipple 24 to close and thus protect the well 10 in the well-known manner.

Figure 6:
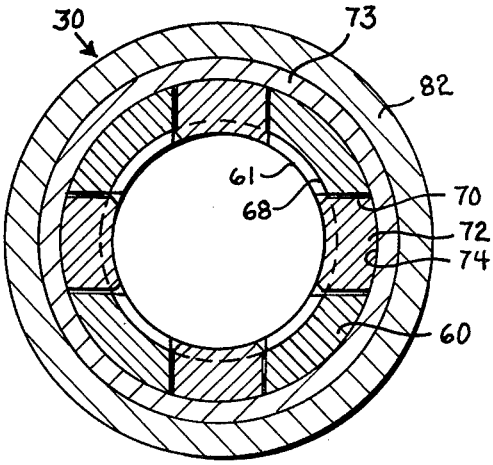
FIG. 6 is a cross-sectional view taken along line 6—6 of FIG. 5.

The well tubing 16 also includes two tool stopping devices which embody the present invention. These devices are indicated by the reference numerals **30*a* and 30*b* in FIG. 1, but by reference numeral 30 in FIGS. 3, 5, and 6. These devices 30*a* and 30*b* in FIG. 1 are supplied fluid pressure from control unit 32 conducted to them through a common control line 34** although a separate control line and, if desired, a separate control unit could be provided for each of the devices.

If desired, one or more tool stopping devices 30 could be placed in the flow line 22, especially if the pump station from which the well tools are to be pumped is located a considerable distance away from the well. Any desired number of such devices could be used in the flow line and tubing.

Figure 2:
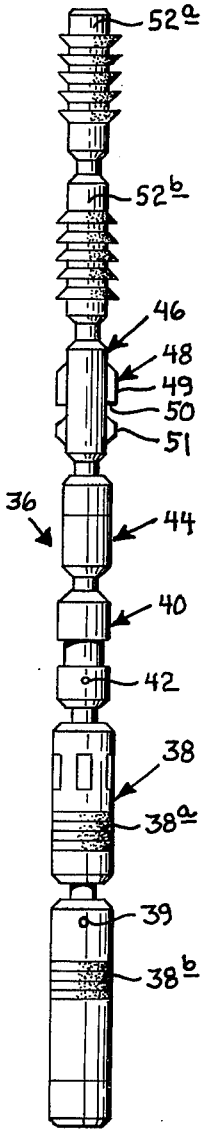
FIG. 2 is an enlarged longitudinal view in elevation showing a pumpdown tool train with a subsurface safety valve ready to be run into the well of FIG. 1.

The tool train to be pumped into the well may be like that of tool train 36 shown in FIG. 2. Because pumpdown tools necessarily allow some leakage or bypass past them, their location is generally questionable at best because merely measuring the volume of liquids pumped is not a true indication of their location. The tool stopping devices 30, whether placed in the well tubing 16 or in the flow line 22, will be placed at known locations, that is, at known distances from the pump station, or in the tubing, at known distances below the master valve 20, for instance, or at known distances above or below important items of well equipment such as landing nipples and the like.

The tool train 36 as shown in FIG. 2 is ready for running and installing a safety valve in landing nipple 24. Tool train 36 comprises a pumpdown type surface controlled subsurface safety valve 38 to the upper end of which is attached a running tool 40 which is releasable from the safety valve by shearing its shear pin 42. The running tool has its upper end connected to a shock absorber 44, and above this is a key mandrel 46 having a pair of keys 48 which are spring-pressed outwardly by springs (not shown) and each of which has an upper boss 49, an abrupt stop shoulder 50 and an external boss 51 therebelow. Above the key mandrel 46 is a pair of pumpdown piston units 52*a* and 52*b* connected thereto. One of these piston units, 52*a*, is for forcing the tool train into the well, and the other piston unit, 52*b*, is for forcing the tool train back out of the well.

When the safety valve 38 is seated in the landing nipple 24, its seal ring sets 38*a* and 38*b* seal above and below the control line connection 24*a*, and control fluid pressure may be applied through port 39 to operate the safety valve from the surface in the conventional and well-known manner.

Figure 3:
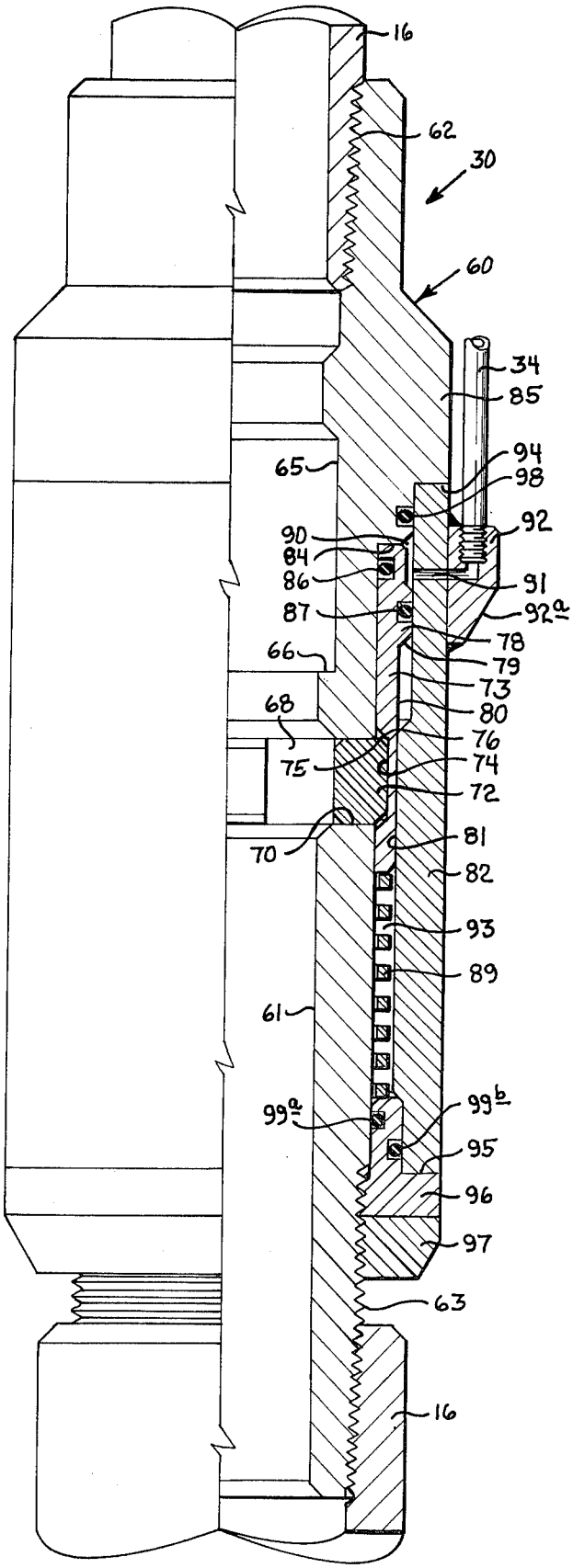
FIG. 3 is a longitudinal view, partly in section and partly in elevation, showing a tool stopping device constructed in accordance with the present invention.

The tool stopping device 30 of FIG. 3 comprises a tubular body 60 having a bore 61 and having means at its opposite ends such as threads 62 and 63 by which it may be connected into the tubing string 16 to become a part thereof. The bore 61 of body 60 is preferably full opening, being substantially as large as the tubing bore, or at least adequately large to pass conventional well tools. An internal annular locator recess 65 having an abrupt stop shoulder 66 defining its lower limit is formed in the inner wall of bore 61 as shown, and another recess 68 is formed below and adjacent recess 65 as shown. This pair of recesses 65 and 68 corresponds to the profile of the keys 48 on the tool train, and when the keys 48 encounter the pair of recesss 65 and 68 in the device 30, the keys will spring outwardly and engage therein, the stop shoulder 50 on the key coming to rest upon stop shoulder 66 in the device and boss 51 of the keys engaging in recess 68 of the device. Thus, when the tool train reaches one of the devices 30, its keys will engage stop shoulder 66, and the tool train will be stopped. With the tool train stopped, flow becomes appreciably restricted, and pump pressure increases, indicating arrival of the tool train at the tool stopping device.

When the tool train is stopped, the shock absorber 44 softens the impact, and the shear pin 42 of the running tool 40 is protected from being sheared prematurely.

The body 60 of device 30 is provided with a plurality of lateral windows 70 formed through the wall thereof adjacent stop shoulder 66. These windows 70 may be located immediately above stop shoulder 66, but may be located on a level with recess 68 as shown, if desired. A lug 72 is disposed in each of the windows 70 and is radially movable therein between a retracted position, shown in FIG. 3, and a contracted position, shown in FIG. 5.

An annular cam sleeve or piston 73 having an internal annular recess 74 surrounds the body 60 and is aligned with windows 70 when the piston is in its upper position, as shown in FIG. 3. The lugs 72 are thus free to move to their outer position and project outwardly into recess 74 of the piston 73.

The upper wall of recess 74 of the piston 73 is defined by a cam surface 75 which is inclined upwardly and inwardly. When the piston moves downwardly, this cam surface 75 engages the corresponding inclined surface 76 on the upper outer corner of the lugs 72 and will cam them inwardly to their innermost position, shown in FIG. 5.

Cam sleeve or piston 73 is formed with an external flange or enlargement 78 providing an inclined downwardly facing shoulder 79 which engages a corresponding upwardly facing inclined shoulder 80 formed in the bore 81 of the housing 82 which surrounds the piston and body. Upward movement of the piston is limited by its upper end engaging downwardly facing shoulder 84 provided by enlargement 85 of the body 60.

Seal means are provided for sealing between the inner wall of the piston 73 and the body 60 and between the outer side of the piston enlargement 78 and the inner wall of the housing 82. These seal means are in the form of resilient seal rings such as o-rings 86 and 87 carried in suitable internal and external annular grooves, respectively formed in the piston 73 as shown.

The area of the circle sealed by seal ring 87 minus the area of the circle sealed by seal ring 86 constitutes an annular area of the piston which is responsive to control pressure conducted into chamber 90 through lateral port 91 which communicates with boss 92 attached to the exterior of housing 82 and which fluidly communicates with a source of fluid pressure. While control fluid pressure may be transmitted to device 30 from the surface through the annulus 31 between the tubing and the casing, it is generally preferable to provide a control line such as control line 34 for this purpose because it is more reliable since it is less likely to contain debris.

The housing 82 is confined between downwardly facing shoulder 94 of the body and upwardly facing shoulder 95 on nut 96 attached to the body as by thread 63 and securely locked in place by lock nut 97. A suitable seal ring such as seal ring 98 seals between the body and the inner wall of the housing 82 at its upper end. Nut 96 carries suitable seal rings such as seal rings 99*a* and 99*b* which seal between the body 60 and the nut 96 and between the nut and the inner wall of the housing 82 near its lower end.

The housing thus surrounds the body 60 and provides an annulus 93 in which the piston 73 is housed. This annulus is sealed at its upper end by seal ring 98 and at its lower end by seal rings 99*a* and 99*b*.

Also housed in the annulus 93 is coil spring 89 which is supported on the upper end of nut 96 with its upper end engaging the lower end of the piston 73. The spring, then, biases the piston upwardly towards its upper position seen in FIG. 3. When control pressure in chamber 90 acting against the pressure responsive area of the piston creates a force sufficient to overcome the upward bias of spring 89, and the frictional drag of the piston, of course, the piston will be forced downwardly, and its cam surface 75 coacting with the cam surface 76 on the lugs 72 will cam the lugs inwardly to their contracted or tool-releasing position seen in FIG. 5. It is readily understood that when piston 73 is in its upper position and its internal recess 74 is aligned with windows 70, as seen in FIG. 3, the keys 48 of the tool train 36 may spring outwardly and move the lugs 72 outward to their FIG. 3 position as the bosses 49 and 51 of keys 48 engage the recesses 65 and 68, respectively, of device 30, as just explained.

Thus, it can be readily understood that when the piston is in its upper position as seen in FIG. 3, a tool train such as tool train 36 seen in FIG. 2 and having suitable keys such as keys 48 may be moved as by fluid pressure into the well tubing 16 of well 10, and when these keys 48 reach the device 30 (seen in FIG. 3), they will spring outwardly and their bosses will engage the pair of body recesses 65 and 68 and their downwardly facing stop shoulder 50 will engage stop shoulder 66 at the lower end of recess 65. The engagement of these stop shoulders 50 and 66 will stop the tool train 36 with the result that the circulation of pumped fluids will be restricted severely and the pump pressure will increase accordingly. This increase in pump pressure will be observed at the surface or pump station, and it will be known that the tool train has been stopped at the device 30.

The tool train cannot move past the device 30 until the keys 48 of the tool train are depressed inwardly, and this is accomplished by applying control fluid pressure to the device 30. This control fluid pressure is applied through control line 34 to the upper side of piston 73 which then moves down and forces lugs 72 inwardly to engage key bosses 51 to depress and release the keys 48 so that the tool train is dislodged and allowed to pass through and beyond the tool stopping device 30. Of course, to prevent undue wear and tear on the stopping device and the tool train, it is preferred that the circulation of the pumped medium be stopped or reduced severely prior to dislodging the pumpdown tool train.

After the tool train is dislodged from the tool stopping device 30, pumping of circulation medium is resumed to force the tools along and through the well flow conduit. When the tool train has cleared the device 30, control fluid pressure is released from control line 34. When control pressure has been reduced sufficiently, spring 89 will force piston 73 back to its upper position and lugs 72 will be freed for outward travel.

When the tool train 36 reaches the next tool stopping device 30, the keys 48 will again expand and engage its stop shoulder to arrest movement of the tool train, thus causing it to lodge. As a result, an increase in pump pressure will be observed at the surface and it will be known that the tool train has arrived at this next checkpoint.

Figure 5:
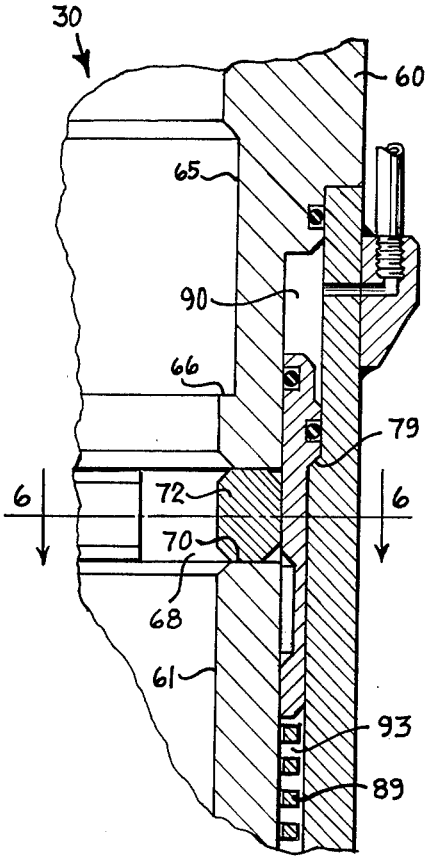
FIG. 5 is a fragmentary view similar to FIG. 3 showing a portion of the device of FIG. 3 with the lugs thereof in retracted position.
Figure 4:
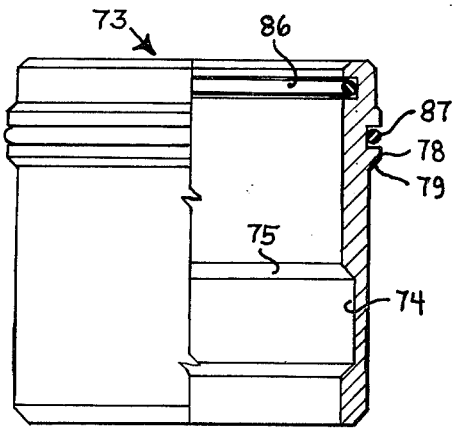
FIG. 4 is a longitudinal view, partly in section and partly in elevation, showing the cam sleeve or piston of the device of FIG. 3.

It should be noticed that when the lugs 72 are in their inner, tool-releasing position, as shown in FIG. 5, they do not project into the open bore of the tool stopping device. Thus, they cannot interfere with the free passage of tools through the device. Therefore, to inadvertently dislodge the tool train while pumping continues would not cause damage to the tool train or stopping device, with the exception that it would cause undue wear on the stop shoulders 50 and 66 of the tool train and device by disengaging them under such excessive load.

The tool stopping device 30 as seen in FIGS. 3–6 is provided with an abrupt stop shoulder 66 which faces upwardly while the keys 48 on the tool train 36 are each provided with a corresponding abrupt downwardly facing stop shoulder 50. These two abrupt stop shoulders are adapted to coengage and arrest descent of the tool train as it moves down the well flow conductor, that is, in a direction away from the pump station and toward the lower end of the well bore.

If it is desired to arrest ascent of the pumpdown tool train on its return trip so that its location can be learned at one or more checkpoints on the way out of the well, one or more tool stopping devices such as tool stopping device 30 may be included in the well flow conductor at desired locations. These tool stopping devices must be inverted and the tool train such as tool train 36 must include a set of keys like keys 48 but inverted.

Thus, these inverted keys will pass freely down the well, but on their return trip they will engage the downwardly facing abrupt stop shoulder of each of the inverted tool stopping devices.

Figure 7:
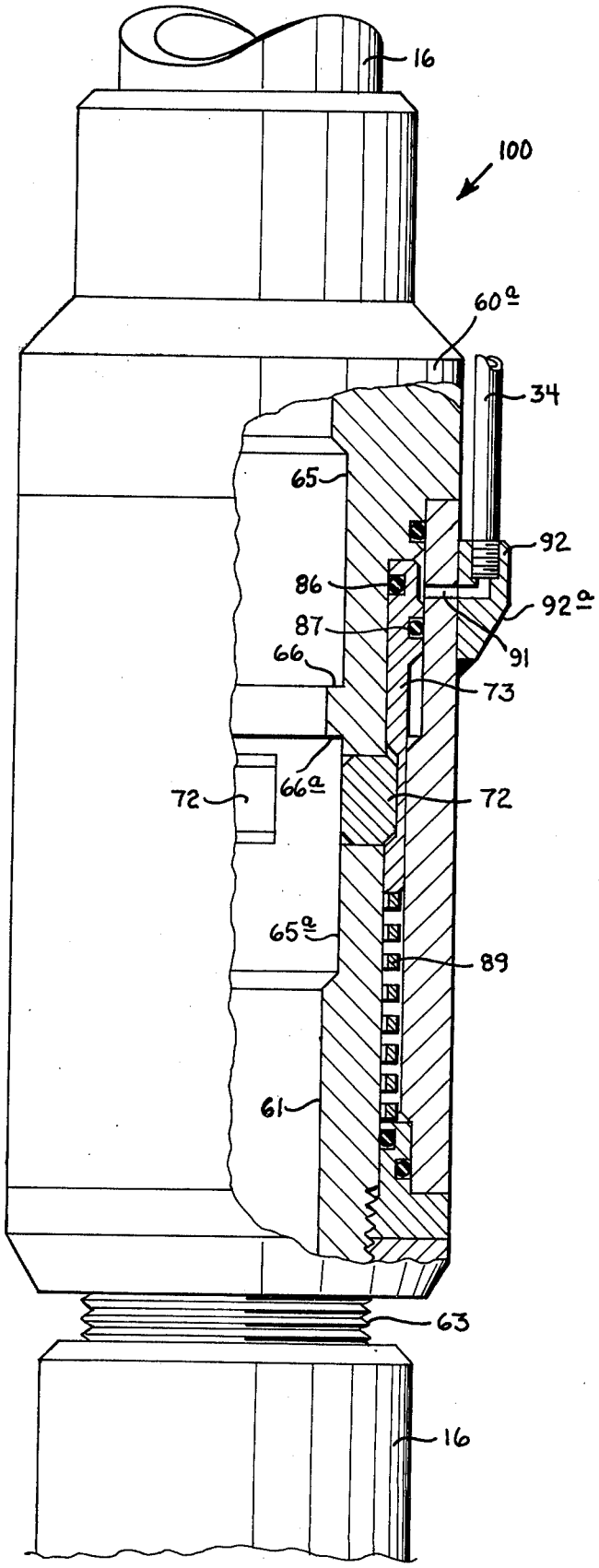
FIG. 7 is a view similar to FIG. 3 showing a modified form of the invention adapted for stopping tools entering the device from either longitudinal direction.

For such inverted use, the tool stopping devices such as device **30*a* of FIG. 1 can be used, as is, merely by inverting the device. Thus, such devices can be used in plurality in a flow conductor. The lowermost device, however, like the device 30*b* shown in FIG. 1 should preferably have a boss 92 (FIG. 3) which provides a wedge-shaped guide 92*a* at its lower end to facilitate lowering the tubing past obstructions in the well. Therefore, on the inverted device, the boss 92** should be kept upright, that is, with its guide surface facing down.

Where it is desired to stop tool trains both as they are lowered into and as they are withdrawn from a well flow conductor, use of the tool stopping device shown in FIG. 7 is to be preferred since it is adapted for stopping tools arriving thereat from either direction.

Referring now to FIG. 7, it will be seen that the bidirectional tool stopping device is indicated generally by the reference numeral 100.

Tool stopping device 100 may be formed exactly like the tool stopping device 30 previously described except for a modified body **60*a***.

The body **60*a* has been modified by replacing the recess 68 of device 30 with recess 65*a* which is exactly like recess 65 but inverted so that its abrupt stop shoulder 66*a* faces downwardly whereas the abrupt stop shoulder 66 of recess 65 faces upwardly. All of the other parts of device 100 may be exactly like the corresponding parts of device 30** and function in exactly the same manner.

When a tool train enters the device from above, the downwardly facing abrupt stop shoulder 50 of the keys on the tool train will engage upwardly facing stop shoulder 66 in device 100, and the descent of the tool train will be arrested as before explained. Circulation of pumped fluids is preferably stopped temporarily at this time. The tools are releasable for further downward movement past and beyond device 100 by applying fluid pressure through control line 34. This fluid pressure enters the device through boss 92 and lateral port 91 to act upon the area of piston 73 sealed by seal rings 86 and 87. When the downward force thus created on the piston becomes sufficient, the piston will move downwards, compressing spring 89 and camming lugs 72 inwardly to engage the bosses 51 of the keys 48 of the well tool to depress them and disengage their stop shoulders 50 from stop shoulder 66 of the device 100 for continued downward movement, as before explained. Pumping of circulating fluids is now resumed.

After the tools have been released and passed through device 100, control pressure is released from control line 34, and spring 89 will force the piston back to its upper position shown, all in the same manner as described previously with respect to the first embodiment.

When a tool train having inverted keys 48 enters the device from below, the abrupt upwardly facing stop shoulder 50 on the keys 48 will engage abrupt downwardly facing shoulder 66*a* in the device 100 and will arrest upward movement of the tool train. Pumping of circulating fluids is stopped temporarily.

To release the tool train for continued upward movement through the well flow conductor, fluid pressure is applied to device 100 through control line 34 as before explained. This fluid pressure will depress piston 73 and will cam the lugs 72 inwardly. The lugs, this time, will engage the boss 49 of the keys near the abrupt shoulder 50 and will depress the keys to disengage their abrupt shoulders from abrupt shoulder 66*a* of the device and allow the tool train to pass upwardly through the device 100. Pumping of circulating fluids is then resumed.

Thus, the device 100 is a dual-purpose device since it is useful in stopping tool trains entering it from either longitudinal direction.

Thus, it has been shown that this invention can be embodied in a single-purpose tool stopping device such as device 30 which is useful in stopping well tools moving through a well flow conductor and entering the device from a single longitudinal direction; and that such single-purpose tool can be inverted and used in stopping tools entering the same from the opposite direction. It has also been shown that the invention may be embodied in a dual-purpose tool stopping device which is useful in stopping well tools entering the device from either longitudinal direction; and that a plurality of either of the devices can be used at known locations in a well flow conductor to indicate the arrival of tool trains thereat. It is understandable that the single-purpose and dual-purpose devices can be intermixed as desired. It is further understood that when the lugs of any such device are held in their innermost or tool-releasing position, the keys on a tool train cannot engage its abrupt stop shoulder and the tool train will readily pass unhindered and undamaged through the device; and that the recesses such as recesses 65 and 68 as well as recesses 65 and 65*a* have been shown and described for their simplicity, and any suitable recess configuration could be used. Further, it should be noted that in any given well flow conductor, all such devices would be adapted for stopping tool trains equipped with a single type of keys. However, it is anticipated that a plurality of sets of devices could be used in a single well flow conductor with each set compatible with a certain type of key and the other set or sets compatible with another or other types of keys. Also, since the tool trains normally used are generally short in comparison with the space between devices in the flow conductor, all of the devices, such as device 30, or device 100, may be operated by fluid pressure supplied thereto through a single control fluid conduit, although a separate control fluid conduit may be provided if desired.

The foregoing description and drawing figures have been herein presented by way of explanation only, and variations in shapes, sizes, and arrangement of parts may be had by those skilled in the art without departing from the true spirit of the invention.

We claim:

1. A device for stopping a well tool moving through a well flow conductor, said well tool having key means thereon providing abrupt stop shoulder means, said device having means for releasing said well tool for movement past said device, including:

a. tubular body means connectable in said well flow conductor and having internal annular recess means providing abrupt stop shoulder means therein engageable by said abrupt stop shoulder on said key means of said well tool;

b. lateral windows in said body adjacent said abrupt stop shoulder;

c. a lug in each of said windows radially movable between outer and inner positions; and d. pressure responsive means for moving said lugs between their outer and inner position to disengage said key means from said abrupt stop shoulder in said body.

2. The tool stopping device of claim 1 wherein said pressure responsive means includes longitudinally movable cam sleeve means surrounding said body and said lugs and having a cam shoulder thereon engageable with an outer surface of each lug to cam said lug inwardly responsive to longitudinal movement of said cam sleeve relative to said body and lugs from tool engaging to tool releasing position.

3. The tool stopping device of claim 2 wherein said pressure responsive means further includes:

a. housing means disposed about and spaced from said body and forming an annulus therebetween housing said cam sleeve;

b. means on said body means closing said annulus at its opposite ends;

c. seal means on said cam sleeve sealing with said body above said windows and with said housing and providing a pressure responsive piston area; and d. means for conducting fluid pressure into said annulus to act on said piston area to move said cam sleeve longitudinally in a first direction relative to said body and said lug means.

4. The tool stopping device of claim 3 wherein said means for moving said cam sleeve further includes spring means in said annulus engaged with said cam sleeve for moving said cam sleeve in a second direction opposite said first direction to allow said lugs to move from their inner to their outer positions.

5. The tool stopping device of claim 4 wherein the bore of said tubular body is full opening and said lugs do not restrict said bore at any time.

6. The device of claim 5 wherein said internal annular recess means in said body means includes a pair of internal annular recesses providing a pair of oppositely facing abrupt stop shoulders, each said abrupt stop shoulder being engageable by an abrupt stop shoulder on a well tool but entering the tool stopping device from a different direction.

7. A device for stopping a well tool moving through a well flow conductor, said well tool including key means having abrupt stop shoulder means thereon, said device comprising:

a. a tubular body connectable in a well flow conductor in coaxial relation therewith;

b. said body being formed with a pair of spaced internal annular recesses, at least one of said pair of annular recesses providing an abrupt stop shoulder surrounding the bore of said body engageable by the key means on said well tool to stop said well tool at said device;

c. a plurality of circumferentially spaced windows formed in the wall of said body adjacent said abrupt stop shoulder;

d. a lug mounted in each of said windows for radial movement between inner and outer positions;

e. annular piston means surrounding said body and movable longitudinally thereon, said piston having an annular cam surface thereon for camming said lug inwardly to their inner position on movement of said piston in a first direction;

f. housing means surrounding said body and spaced therefrom to form an annulus therebetween, housing said piston;

g. means closing the opposite ends of said annulus;

h. seal means sealing between said piston and said body above said windows and between said piston and said housing, the difference between these two areas sealed constituting a pressure responsive area on said piston; and i. means for conducting pressurized fluid into the interior of said housing to act against said pressure responsive area and move said piston in said first direction to cause said lugs to be cammed from their outer to their inner position.

8. The device of claim 7 further including spring means in said annulus biasing said piston in a second direction opposite said first direction.

9. The device of claim 8 wherein the bore of said body is full opening and said lugs when in their inner position do not restrict said full open bore.

10. The device of claim 8 wherein said pair of internal annular recesses provides a pair of oppositely facing abrupt stop shoulders each engageable by key means on said well tool for stopping said well tool encountering said device from either longitudinal direction.

11. The device of claim 10 wherein the bore of said body is full opening and said lugs when in their inner position do not restrict said full open bore.

12. A well system for stopping well tools at known checkpoints in a well flow conduit and subsequently releasing said well tools for movement through and beyond the checkpoint at which said well tools had been stopped, said well tools having key means with abrupt shoulder means thereon, said system comprising:

a. a well bore;

b. a well tubing in said well bore;

c. at least one tool stopping device connected in coaxial relation in said well tubing, each such tool stopping device being disposed at a known location in said well tubing, each such tool stopping device including tubular body means, annular recess means in said body providing abrupt stop shoulder means surrounding the bore of said body, said stop shoulder means being engageable by a well tool moving through said well tubing, said tool stopping device also including lug means in windows adjacent said stop shoulder means in said body, said lugs being movable between outer and inner positions by a longitudinally movable piston having a cam surface thereon engageable with said lugs, said piston being remotely actuable by fluid pressure conducted thereto from the surface to disengage said well tool from said stop shoulder in said body and allow said well tool to move past said tool stopping device; and d. control fluid conduit means having one end thereof fluidly connected to said at least one tool stopping device and its other end connected to a source of fluid pressure at the surface.

13. The system of claim 12 wherein said control fluid conduit means includes the annulus between the well tubing and the well bore.

14. The system of claim 12 wherein said control conduit means is a small diameter tubing providing a conduit separate from the annulus.

15. The system of claim 14 wherein the small diameter tubing constituting the control conduit means is connected to all of the tool stopping devices and all such devices are actuated in unison.

16. The system of claim 15 wherein at least one of said at least one tool stopping device has a full open bore and said lugs when in their inner position do not restrict said full open bore.

17. The system of claim 16 wherein each of said tool stopping devices in said system has a full open bore and said lugs when in their inner position do not restrict said full open bore.

* * * * *